US006228132B1

(12) United States Patent
Prince et al.

(10) Patent No.: US 6,228,132 B1
(45) Date of Patent: May 8, 2001

(54) PROCESS FOR MODIFYING SILK

(75) Inventors: Phillip Prince; Irene Cheng, both of Los Angeles, CA (US)

(73) Assignee: Innovative Products, Canoga Park, CA (US)

( * ) Notice: Subject to any disclaimer, the term of this patent is extended or adjusted under 35 U.S.C. 154(b) by 0 days.

(21) Appl. No.: 09/465,916

(22) Filed: Dec. 17, 1999

(51) Int. Cl.[7] ..... D06M 13/188; C09B 61/00; D06P 1/34

(52) U.S. Cl. ..... 8/594; 8/128.1; 8/646; 8/917

(58) Field of Search ..... 8/128.1, 594, 917, 8/646

(56) References Cited

U.S. PATENT DOCUMENTS 354,223 * 12/1886 Randall .
4,014,973 3/1977 Thompson .
4,141,207 2/1979 Mizushima et al. .
4,929,248 5/1990 Fuse et al. .
5,250,077 10/1993 Fuse et al. .
5,296,269 3/1994 Yang et al. .
5,849,040 * 12/1998 Kanehisa .

* cited by examiner

*Primary Examiner*—Margaret Einsmann
(74) *Attorney, Agent, or Firm*—David B. Abel; Squire, Sanders & Dempsey LLP.

(57) ABSTRACT

Modified silk processed according to an embodiment of the present invention is an all-natural stretchable silk textile processed without synthetics. The modified silk includes commercially-advantageous physical properties such as stretchability and it is machine washable, wrinkle resistant, stain resistant, and water proof/repellant, which render the silk very versatile and wearable. The process comprises collecting silk, boiling the silk in a water and vinegar solution, whereupon the silk becomes stretchable or elastic. The silk may then be soaked in water and vinegar to add a wrinkle resistant effect. The silk is then fabricated into a silk textile for example in a cross weave configuration, adding an elastic quality without synthetics. The finished product may then be soaked in lemon grass and water to make it stain resistant.

10 Claims, 3 Drawing Sheets

PROCESS FOR MODIFYING SILK

BACKGROUND OF THE INVENTION

1. Field of the Invention

The present invention relates to silk textiles, and more particularly, to a simple, all-natural process that improves the physical properties of silk and silk textiles.

2. Description of Related Art

Silk is a fiber obtained as a filament from a cocoon produced by a silkworm. The silkworm can be a larva of the Chinese silkworm moth, Bombyx mori, or a larva of several moths of the Satumiidae family. A textile is any cloth or goods produced by weaving, knitting, or felting. Materials such as natural and synthetic fibers or yarn that are suitable for weaving are also textiles.

Silk textiles are very popular and widely used for clothing purposes because of their elegant appearance and comfort. Silk textiles generally dye well, they can be woven or knit, and they have the ability to retain heat in cold weather while staying cool in hot weather. However, natural silk textiles generally wrinkle, do not stretch, and deform permanently if machine washed. Although silk can be dry cleaned, dry cleaning is expensive and is relatively ineffective at removing certain types of stains such as perspiration stains.

Chemical finishes exist that improve certain commercially important properties of silk. For example, glyoxal resin finishes with ethylene urea are reported to produce a silk textile having good crease-recovery, particularly when used with a metal-acid catalyst. Urethane resins with or without formaldehyde are reported to be suitable for producing machine-washable silk. Further, it is known that epoxides, siloxanes, amino-plasts and glyoxal can be dispersed in a sodium-hydroxide solution and applied to silk textiles to increase the washability of the textiles. Similarly, application of hydroxymethylmetracrylamine may improve crease-resistance and dimensional stability. A combination of glycerol and ammonium chloride may also increase wrinkle recovery.

There also exist materials consisting of silk blended with synthetics, such as Lycra®, to make a stretchable fabric. A formaldehyde-free silk finishing process that uses a monobasic acid, a polycarboxylic acid and a phosphorous-containing salt catalyst that can improve crease-resistance of silk textiles without decreasing their durability is disclosed in U.S. Pat. No. 5,296,269 to Yang.

However, problems associated with these prior art processes that use artificial chemicals arise because they may cause associated health problems or are potential allergens. In addition, not all of the limitations of natural silk are resolved. The wide appeal of silk textiles for use in clothing is based on several commercially important properties, but improving one or two of the properties, at the expense of others, does not fulfill a need for silk textiles that are elegant, comfortable to wear, machine-washable, stain proof, wrinkle proof, and stretchable.

Accordingly, the need exists for a natural silk textile that overcomes the drawbacks of the prior art and has improved physical properties including stretchability, waterproof, wrinkle-resistant, stain-resistant, and overall improved wearability obtained by a simple, all-natural process that does not require the use of synthetics or artificial chemicals.

SUMMARY OF THE INVENTION

In accordance with the teachings of this invention, a process for modifying silk is provided. The processed silk textile of the present invention is an all-natural, three way stretchable fabric without synthetics. The fabric is machine washable, wrinkle resistant, stain resistant, water proof/repellant, and when stretched and released, the textile returns to its natural shape.

The process for modifying silk includes providing raw silk and/or collecting silk scraps from silk production and then "boiling off" the silk in a mixture of water and vinegar, which causes the silk threads to curl and thereby makes the silk fiber stretchable or elastic. The processed silk is then soaked in water and vinegar, which adds a wrinkle resistant effect. The processed silk is then fabricated into silk weave or knit in any desired configuration, and the resulting silk textile has an elastic quality without requiring or incorporating any synthetics. The finished product may then be soaked in a mixture of lemon grass and water to make the silk textile stain resistant. Further, the finished product may be vegetable dyed, printed, appliqued, embroidered, and/or embellished.

A more complete understanding of the process for modifying silk will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention provides a process for modifying silk that satisfies the need for an all-natural silk textile that is stretchable, water proof/repellant, stain resistant, wrinkle resistant, machine washable, and easy to fit without the use of any synthetics. In the detailed description that follows, it should be appreciated that like element numerals are used to describe like elements illustrated in one or more of the figures.

Figure 1:
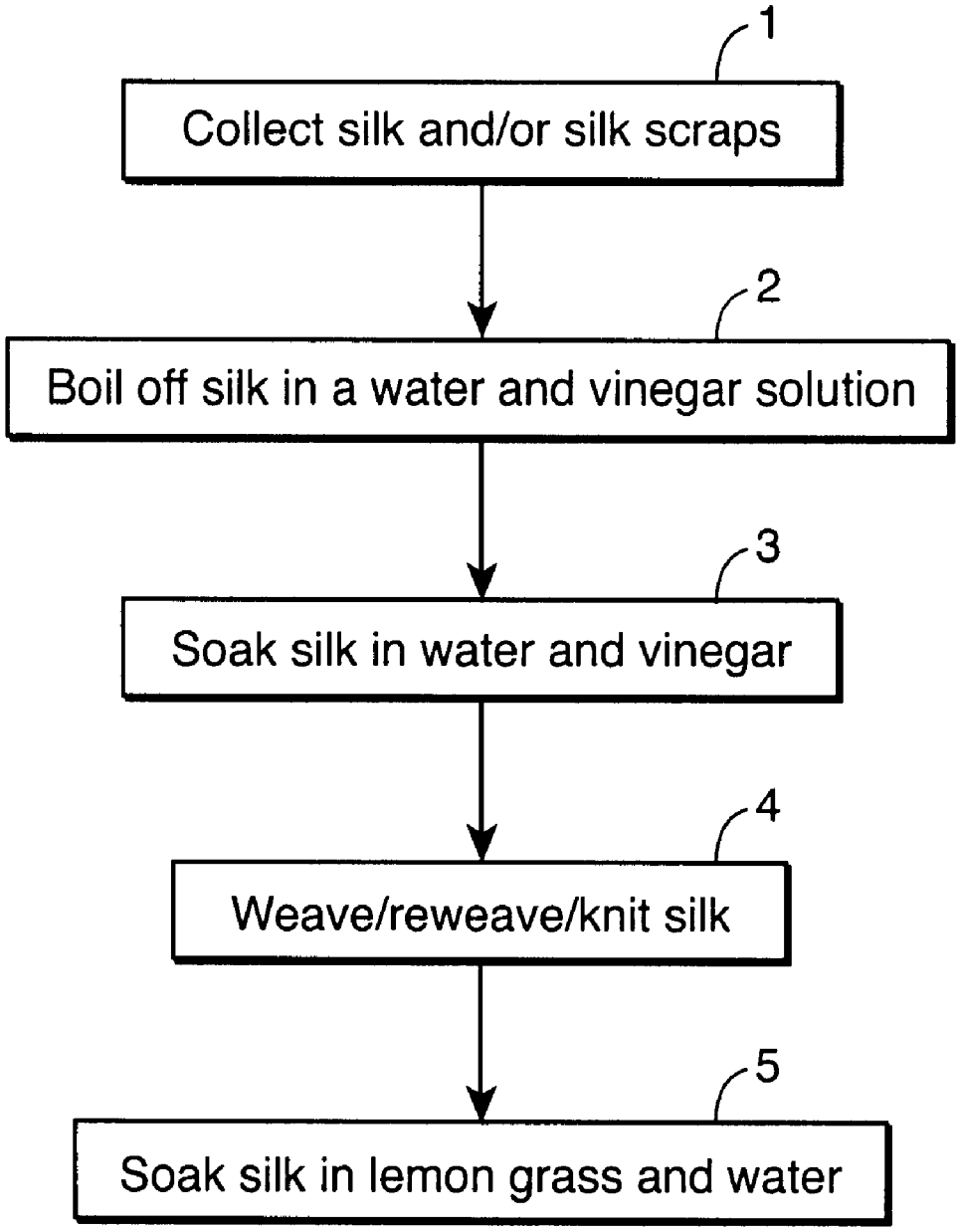
FIG. 1 is a block diagram illustrating a process for modifying silk according to an embodiment of the present invention.

Referring first to FIG. 1, a block diagram illustrating a process for modifying silk according to an embodiment of the present invention is provided. In the first step 1, silk or silk fiber scraps or samples are collected from silk production. The quality of silk is gauged in mummy weight. A mummy weight of 8 mm is considered to be of low quality and a mummy weight of 50 mm is considered to be of high quality. Silk that is 45–90 mummy heavy is thicker than regular silk and 90 percent more wrinkle resistant. Thus, heavy mummy weight silk is preferable.

In the second step 2, the silk is boiled off in water and vinegar. The vinegar concentration may be in the range of approximately 40% to 90%, but a concentration of approximately 40% to 60% is preferred. The best results have been obtained with a mixture of approximately 50% water and approximately 50% vinegar. The mixture is then heated, preferably to a boil and then the elevated temperature is sustained for an appropriate amount of time. Preferably, the boil off occurs at a temperature above 200° F., optimally, 212 degrees Fahrenheit for approximately 18–20 minutes. As it is boiled, the silk curls adding a stretch or elastic property. It has been found that the higher the vinegar concentration (to 50%) in the mixture and the higher the temperature (to 212 degrees) of the water, the more the silk samples become elastic.

In the third step 3, the silk is soaked in a mixture of water and vinegar in proportions similar to those set forth above, preferably for an extended time, for example approximately two days. This step gives the silk a wrinkle resistant property.

In the fourth step 4, the silk is woven, rewoven or knitted in any desired configuration. Preferably, the silk is fabricated into a silk textile in a cross weave configuration, thus adding an elastic or stretch quality to the silk textile without synthetics.

In an optional fifth step 5, the finished silk textile is soaked in a mixture of lemon grass and water in order to make the silk textile stain resistant. It should be noted that substances other than lemon grass may be used to create a stain resistant textile, as is known in the art. Finally, the processed silk textile may be vegetable dyed, printed, appliqued, embroidered, and/or embellished.

Figure 2:
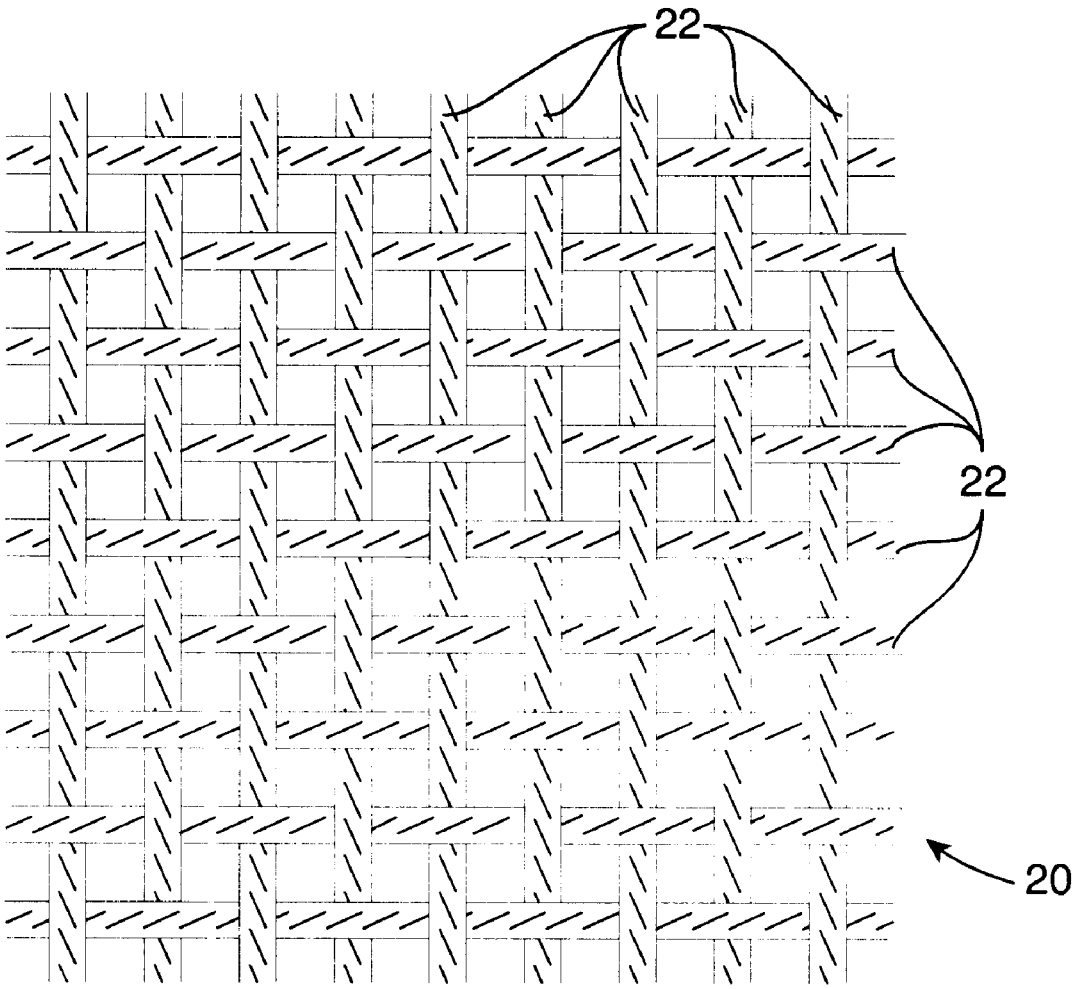
FIG. 2 is an enlarged view of an exemplary small area of an unstretched silk textile.

Referring now to FIG. 2, an enlarged view of an exemplary small area of an unstretched silk textile with exaggerated thread spacing is provided. A processed piece of silk textile 20 is formed of interwoven silk threads 22. At least some of the silk threads 22 are cross-linked with other silk threads or, alternatively, the threads 22 may be twisted. The processed silk textile is wrinkle resistant, water proof/repellant, stain resistant, washable, and stretchable as discussed below.

Figure 3:
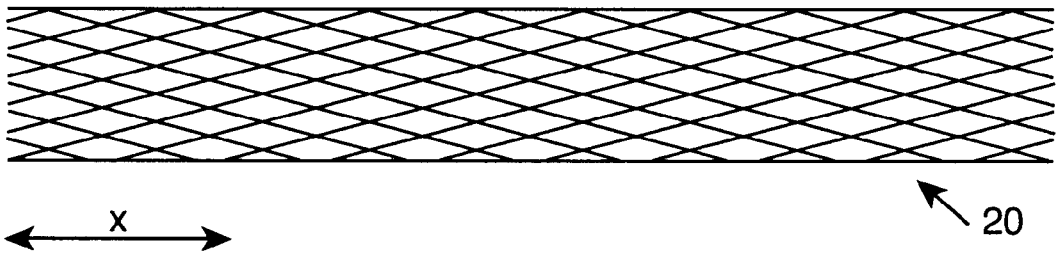
FIG. 3 is a processed silk textile stretched in the X-direction according to an embodiment of the present invention.
Figure 4:
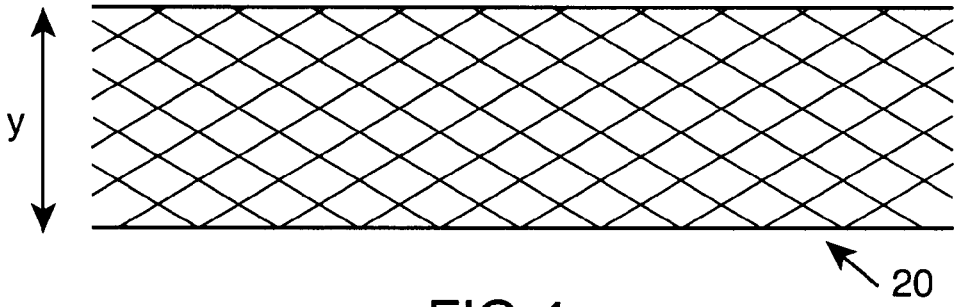
FIG. 4 is a processed silk textile stretched in the Y-direction according to an embodiment of the present invention.

Referring now to FIG. 3, a silk textile processed according to the present invention is shown stretched in the X-direction. A processed piece of silk textile 20 is stretched in the axial or X-direction as shown by the arrow. The silk textile will stretch to at least 10% of its length in both the X and Y directions and at any angle thereto. Samples of the silk textile processed according to the present invention have been measured to stretch to at least 125%, i.e., from one inch to at least approximately 2.25 inches, in the axial or X-direction. FIG. 4 illustrates the processed piece of silk textile 20 stretched in the Y-direction as shown by the arrow. The silk textile has been measured to stretch to at least 80%, i.e., from one inch to at least approximately 1.8 inches, in the Y-direction. It should be noted that unprocessed pure silk generally does not stretch even if the same weave or knit is used, and even silk knits which do appear to stretch do so only in one direction.

The processed finished silk textile of the present invention is an all-natural stretchable fabric that requires no synthetics. Once stretched and released, the silk textile returns to its natural shape. The silk textile may be washed in cold water or machine-washed in gentle cycle. The silk textile is also wrinkle resistant, stain resistant, water proof/repellant, and may be double self-lined.

The silk textile of the present invention is very versatile and can have a variety of uses. For example, the silk textile may be used for clothing items such as suits, shirts, dresses, undergarments, pajamas, swimwear, etc., as well as outerwear such as raincoats, jackets, and wet suits for water sports including surfing, boating, wind surfing, and jet skiing. In addition, the silk textile of the present invention may be used for automobile upholstery, boat and airplane interiors, and luxury vans, as well as for home furnishing uses such as pillows, sofas, chairs, love seats, draperies, wall coverings, etc.

Having thus described a preferred embodiment of the process for modifying silk, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. A process of modifying silk comprising the steps of:

collecting silk formed of silk fibers;

boiling the silk in a mixture of water and vinegar for a sufficient amount of time to impose a curl in said silk fibers;

soaking said curled silk fibers in a mixture of water and vinegar; and forming a silk textile from said curled silk fibers.

2. The process for modifying silk according to claim 1, further comprising the step of treating said silk textile with a solution of lemon grass and water to impart a stain resistant property.

3. The process for modifying silk according to claim 1, further comprising soaking the silk textile in a solution of lemon grass and water.

4. The process for modifying silk according to claim 1, further comprising modifying the silk textile with a process selected from the group consisting of vegetable dyeing, printing, adding an applique, embroidering, and embellishing the silk textile.

5. The process for modifying silk according to claim 1, further comprising providing a mixture comprising approximately 40% to 90% vinegar and the balance being water for the step of boiling the silk.

6. The process for modifying silk according to claim 1, further comprising providing a mixture comprising approximately 40% to 60% vinegar and the balance being water for the step of boiling the silk.

7. The process for modifying silk according to claim 1, further comprising providing a mixture comprising approximately 50% water and approximately 50% vinegar for the step of boiling the silk.

8. The process for modifying silk according to claim 1, wherein said soaking step comprises soaking said curled silk fibers in said mixture of water and vinegar for a sufficient amount of time to impart a wrinkle resistant effect.

9. The process for modifying silk according to claim 1, wherein the processed silk textile fibers with said curl stretch at least 10% of their length.

10. The process for modifying silk according to claim 1, wherein the processed silk textile stretches at least 10% of its length in both the X and the Y directions.

* * * * *